US010586482B1

(12) United States Patent
Yung et al.

(10) Patent No.: US 10,586,482 B1
(45) Date of Patent: Mar. 10, 2020

(54) ELECTRONIC DEVICE WITH AMBIENT LIGHT SENSOR SYSTEM

(71) Applicant: Apple Inc., Cupertino, CA (US)

(72) Inventors: Amanda K. Yung, Cupertino, CA (US); Paul V. Johnson, San Francisco, CA (US); Di Bai, Cupertino, CA (US); Jiaying Wu, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/292,080

(22) Filed: Mar. 4, 2019

(51) Int. Cl.
*G09G 3/20* (2006.01)

(52) U.S. Cl.
CPC ... *G09G 3/2003* (2013.01); *G09G 2320/0666* (2013.01); *G09G 2320/08* (2013.01); *G09G 2360/144* (2013.01)

(58) Field of Classification Search
CPC .. G09G 3/2003; G09G 3/2007; G09G 3/2077; G09G 5/026; G09G 5/10; G09G 2320/0233; G09G 2320/0242; G09G 2320/0271; G09G 2320/0276; G09G 2320/06; G09G 2320/0626; G09G 2320/066; G09G 2320/0666; G09G 2320/0686; G09G 2320/08; G09G 2340/06; G09G 2340/14; G09G 2360/14; G09G 2360/144
See application file for complete search history.

(56) References Cited

U.S. PATENT DOCUMENTS

2008/0303918 A1 12/2008 Keithley
2010/0300856 A1 12/2010 Pance et al.
2010/0301755 A1 12/2010 Pance et al.
2012/0050307 A1 3/2012 Mahowald et al.
2012/0081279 A1 4/2012 Greenebaum et al.
2012/0092541 A1 4/2012 Tuulos et al.
2015/0062186 A1* 3/2015 Park ..... G09G 3/3225 345/690
2015/0070337 A1 3/2015 Bell et al.
2015/0070402 A1 3/2015 Shah et al.
2015/0092186 A1 4/2015 Wieser et al.
2015/0109455 A1 4/2015 Pang
2016/0005362 A1* 1/2016 Chen ..... G09G 3/3406 345/690
2016/0133227 A1 5/2016 Yoon et al.
2016/0372053 A1* 12/2016 Lee ..... G09G 3/342
2017/0229059 A1* 8/2017 Bonnier ..... G06F 3/044
2018/0350323 A1* 12/2018 Whitehead ..... G09G 3/2003

* cited by examiner

*Primary Examiner* — Nathan Danielsen

(74) *Attorney, Agent, or Firm* — Treyz Law Group, P.C.; G. Victor Treyz; David K. Cole

(57) ABSTRACT

An electronic device such as a desktop computer or other device may have an electronic device housing with front and rear faces. A display may be mounted on the front face. The electronic device may include multiple ambient light sensors such as a front color ambient light sensor on the front face and a rear color ambient light sensor on the rear face. The front ambient light sensor gathers a front ambient light intensity measurement and a front ambient light color measurement. The rear ambient light sensor gathers a rear ambient light intensity measurement and a rear ambient light color measurement. During operation, control circuitry in the electronic device takes action based on data from the ambient light sensors. The control circuitry may adjust a white point of the display using a combined color value that is produced using a combining function.

19 Claims, 5 Drawing Sheets

ELECTRONIC DEVICE WITH AMBIENT LIGHT SENSOR SYSTEM

FIELD

This relates generally to electronic devices, and, more particularly, to electronic devices with displays.

BACKGROUND

Electronic devices such as laptop computers, cellular telephones, and other equipment are sometimes provided with light sensors. For example, ambient light sensors may be incorporated into a device to provide the device with information on current lighting conditions. Ambient light readings may be used in controlling an electronic device. For example, ambient light color measurements can be used in adjusting the color cast of a display. When lighting conditions are cool, the white point of a display can be adjusted to a cooler value and when lighting conditions are warm, the white point of the display can be adjusted to a warmer value. These adjustments may help maintain a pleasing appearance for images on a display as ambient light changes color.

SUMMARY

An electronic device such as a desktop computer or other device may have an electronic device housing with front and rear faces. The electronic device may include multiple ambient light sensors such as a front color ambient light sensor on the front face and a rear color ambient light sensor on the rear face.

A front ambient light sensor may gather a front ambient light intensity measurement and a front ambient light color measurement. A rear ambient light sensor may gather a rear ambient light intensity measurement and a rear ambient light color measurement. During operation, control circuitry in the electronic device may take action based on data from the ambient light sensors. For example, the color cast of a display may be adjusted and/or other display adjustments may be made.

The display may be mounted on the front face of the electronic device. The control circuitry may adjust the color cast of the display (e.g., the white point of the display) using a combined color value that is produced using a combining function that operates on ambient light data from multiple sensors. The combining function may be a conditional weighting function that weights the color measurements of the front and rear sensors using linear ambient light intensity weights or using logarithmic ambient light intensity weights depending on whether the electronic device is in a front-lit or rear-lit ambient lighting environment.

DETAILED DESCRIPTION

To adjust the operation of displays and take other actions within an electronic system, ambient light sensors may be used to gather ambient light measurements. The ambient light sensors may be color ambient light sensors that make measurements of light intensity in multiple color channels (e.g., multiple different overlapping visible light wavelength ranges) and that use this information in producing ambient color information. The ambient color information may be provided in the form of color coordinates in a desired color space, a color temperature, a correlated color temperature, a color spectrum, and/or other color data format. Configurations in which ambient color measurements are made using color coordinates may sometimes be described herein as an example.

Figure 1:
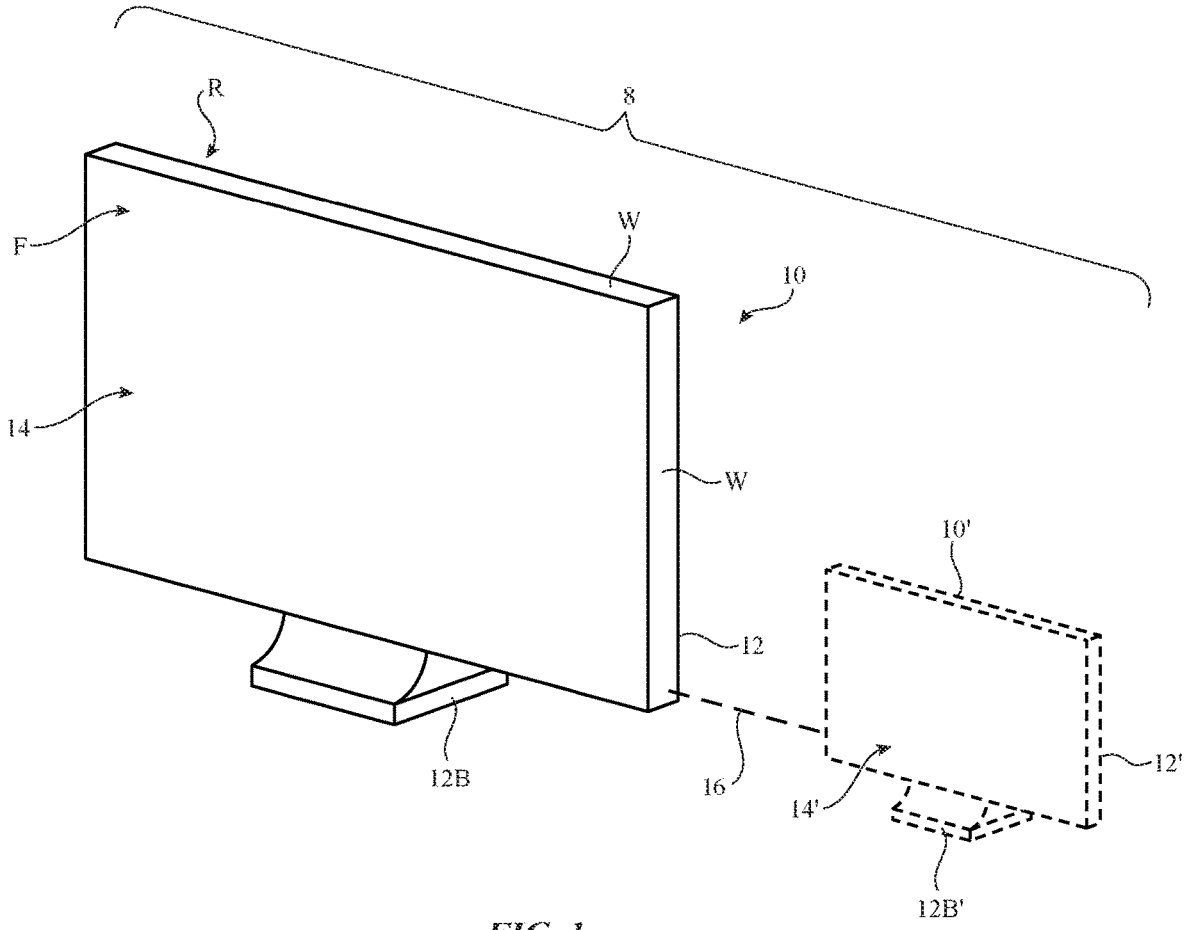
FIG. 1 is a perspective view of an illustrative system having one or more displays in accordance with an embodiment.

FIG. 1 is a perspective view of an illustrative system having one or more electronic devices with color ambient light sensors. As shown in FIG. 1, system 8 may include one or more electronic devices such as electronic device 10 and additional electronic device(s) 10'. As illustrated by device 10, each electronic device 10 may have a housing such as housing 12 that supports a display such as display 14. Housing 12, which may sometimes be referred to as an enclosure or case, may be formed of plastic, glass, ceramics, fiber composites, metal (e.g., stainless steel, aluminum, etc.), other suitable materials, or a combination of any two or more of these materials. Housing 12 may be formed using a unibody configuration in which some or all of housing 12 is machined or molded as a single structure or may be formed using multiple structures (e.g., an internal frame structure, one or more structures that form exterior housing surfaces, etc.). If desired, a portion of housing 12 may form a support structure such as optional stand 12B (e.g., device 10 may be a desktop computer or desktop computer monitor that is supported by stand 12B on a desktop or other support surface). Configurations in which housing 12 forms an enclosure for other types of electronic devices such laptop computers, tablet computers, cellular telephones, and other devices may also be used.

Device 10 has opposing front and rear faces joined by sidewalls. In the illustrative configuration of FIG. 1, housing 12 has portions that form a rear wall on rear face R of device 10 and portions that form sidewalls W (e.g., curved and/or planar sidewalls) for device 10. Display 14 may be mounted on front face F of device 10. A transparent portion of housing 12, which may sometimes be referred to as a display cover layer, may cover display 14 on front face F. The display cover layer portion of housing 12 may be formed from a layer of transparent glass, clear plastic, sapphire, or other clear layer.

Ambient light sensors and other components may be mounted within housing 12. With one illustrative configuration, which is sometimes described herein as an example, a first color ambient light sensor is mounted on front face F of housing 12 and a second color ambient light sensor is mounted on rear face R of housing 12. In this type of configuration, the first and second ambient light sensors face in opposing (opposite) directions and gather ambient light measurements in opposing directions. Other arrangements in which devices such as device 10 have multiple ambient light sensors may be used, if desired.

Display 14 may include an array of display pixels formed from liquid crystal display (LCD) components, an array of electrophoretic pixels, an array of plasma pixels, an array of organic light-emitting diode pixels or other light-emitting diodes, an array of electrowetting pixels, or pixels based on other display technologies. The array of pixels of display 14 forms an active area that displays images for a user of device 10. The active area may be rectangular or may have other suitable shapes. The active area may cover all of front face F or an inactive border area may run along one or more edges of the active area and/or may form isolate island(s) within the active area. An ambient light sensor may be mounted in an area of front face F that is adjacent to the pixels of display 14 or that operates through a window within the pixels of display 14.

System 8 may include multiple electronic devices that are used together. For example, a first electronic device such as device 10 may be used to display a first image on display 14 while one or more additional electronic devices such as illustrative second electronic device 10' may be used to display images on one or more additional displays such as illustrative additional display 14'. Additional display 14' may be mounted in housing 12' of device 10'. Device 10' may be supported by optional stand 12B'. Devices in system 8 such as devices 10 and 10' in the example of FIG. 1 may communicate using wired and/or wireless communications paths (see, e.g., illustrative communications path 16). In some configurations, a main controller (e.g., a desktop computer unit without a display) may communicate with devices 10 and 10' (e.g., in a scenario in which devices 10 and 10' are desktop computer monitors). In other configurations, a first device (e.g., device 10) may serve as a master device and additional device(s) 10' may serve as slave devices. Arrangements in which some or all of the electronic devices in system 8 serve as peer devices in a network may also be used.

During operation, control circuitry in system 8 (e.g., control circuitry in device 10 and/or device(s) 10') may be used in processing ambient light measurements and taking appropriate action. For example, ambient light data may be used in determining how to adjust display intensity and/or display color. Display color adjustments, which may sometimes be referred to as color cast adjustments or white point adjustments may be made to adjust the color cast of images on displays such as displays 14 and 14' (e.g., to make images appear warmer or cooler, more or less greenish, etc.). The ambient light measurements that are obtained in system 8 may be obtained from ambient light sensors mounted on front faces F of device 10 and device(s) 10' and/or from ambient light sensors mounted on rear faces R of devices 10 and device(s) 10'. In some system configurations, only a single electronic device may be present (e.g., system 8 may include device 10 and device(s) 10' may not be present). In other configurations, only a pair of devices may be present or three or more devices may be present. When a single display is present, the display may be adjusted based on ambient light readings from opposing front and rear sensors on that device. When multiple devices are present, sensor readings from the front sensors of each of the devices and from the rear sensors of each of the devices may be used in determining which display white point adjustments or other display adjustments (e.g., brightness adjustments) should be made.

Figure 2:
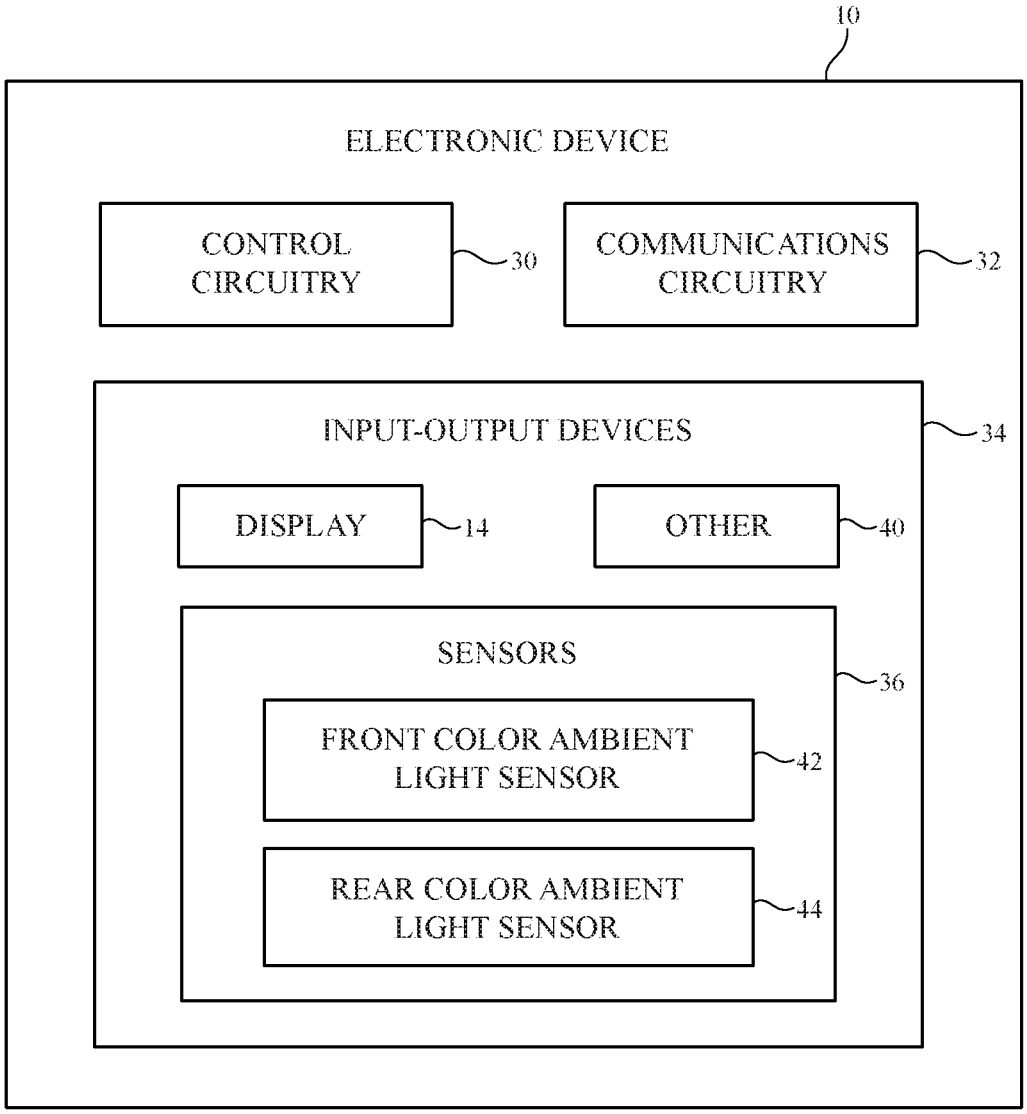
FIG. 2 is a schematic diagram of an illustrative electronic device in accordance with an embodiment.

A schematic diagram of an illustrative electronic device 10 for system 8 of the type that may be provided with one or more light sensors is shown in FIG. 2. Additional electronic device(s) 10' in system 8 may include some or all of the features of illustrative device 10 of FIG. 2.

Electronic device 10 may be a computing device such as a laptop computer, a computer monitor containing an embedded computer, a tablet computer, a cellular telephone, a media player, or other handheld or portable electronic device, a smaller device such as a wrist-watch device, a pendant device, a headphone or earpiece device, a device embedded in eyeglasses or other equipment worn on a user's head, or other wearable or miniature device, a television, a computer display that does not contain an embedded computer, a gaming device, a navigation device, an embedded system such as a system in which electronic equipment with a display is mounted in a kiosk or automobile, equipment that implements the functionality of two or more of these devices, or other electronic equipment.

As shown in FIG. 2, device 10 may include control circuitry 30, communications circuitry 32, and input-output devices 34.

Control circuitry 30 may include storage and processing circuitry for supporting the operation of device 10. The storage and processing circuitry may include storage such as nonvolatile memory (e.g., flash memory or other electrically-programmable-read-only memory configured to form a solid state drive), volatile memory (e.g., static or dynamic random-access-memory), etc. Processing circuitry in control circuitry 30 may be used to gather input from sensors and other input devices and may be used to control output devices. The processing circuitry may be based on one or more microprocessors, microcontrollers, digital signal processors, baseband processors and other wireless communications circuits, power management units, audio chips, application specific integrated circuits, etc.

To support communications between device 10 and external electronic equipment (e.g., other device(s) 10' in system 8), control circuitry 30 may communicate using communications circuitry 32. Communications circuitry 32 may include antennas, radio-frequency transceiver circuitry, and other wireless communications circuitry and/or wired communications circuitry. Circuitry 32, which may sometimes be referred to as control circuitry and/or control and communications circuitry, may, for example, support wireless communications using wireless local area network links, near-field communications links, cellular telephone links, millimeter wave links, and/or other wireless communications paths.

Input-output devices 34 may be used in gathering user input, in gathering information on the environment surrounding the user, and/or in providing a user with output. In some configurations, system 8 may include one or more electronic devices that serve as accessories. For example, one or more portions of devices 10 and/or 10' and/or ancillary equipment in system 8 (e.g., other electronic devices) may serve as keyboards, trackpads, computer mice or other input devices for gathering user input. The user input may be gathered using input-output devices 34 in portions of devices 10 and/or 10' and/or in other devices in system 8 that communicate with devices 10 and/or 10'. User input may include keyboard presses, mouse input, trackpad input, and/or other user input for controlling system 8.

Input-output devices 34 in device 10 may include display 14 (e.g., a display mounted on front face F of housing 12). Display 14 has an array of pixels for displaying images to users. Display 14 may be a light-emitting diode display (e.g., an organic light-emitting diode or a display with a pixel array having light-emitting diodes formed from crystalline semiconductor dies), an electrophoretic display, a liquid crystal display, or other display. Display 14 may include a two-dimensional capacitive touch sensor or other touch sensor for gathering touch input or display 14 may be insensitive to touch. Haptic elements may be used to provide haptic feedback (e.g., haptic feedback in response to display touch sensor input, etc.).

Devices 34 may include sensors 36. Sensors 36 may include force sensors (e.g., strain gauges, capacitive force sensors, resistive force sensors, etc.), audio sensors such as microphones, capacitive touch sensors, capacitive proximity sensors, non-capacitive touch sensors, ultrasonic sensors, sensors for detecting position, orientation, and/or motion (e.g., accelerometers, magnetic sensors such as compass sensors, gyroscopes, and/or inertial measurement units that contain some or all of these sensors), muscle activity sensors (EMG), heart rate sensors, electrocardiogram sensors, and other biometric sensors, radio-frequency sensors (e.g., radar and other ranging and positioning sensors), humidity sensors, moisture sensors, and/or other sensors.

Sensors 36 and other input-output devices 34 may include optical components such as light-emitting diodes (e.g., for camera flash or other blanket illumination, etc.), lasers such as vertical cavity surface emitting lasers and other laser diodes, laser components that emit multiple parallel laser beams (e.g., for three-dimensional sensing), lamps, and light sensing components such as photodetectors and digital image sensors. For example, sensors 36 in devices 34 may include optical sensors such as depth sensors (e.g., structured light sensors and/or depth sensors based on stereo imaging devices that can optically sense three-dimensional shapes), optical sensors such as self-mixing sensors and light detection and ranging (lidar) sensors that gather time-of-flight measurements and/or other measurements to determine distance between the sensor and an external object and/or that can determine relative velocity, proximity sensors based on light (e.g., optical proximity sensors that include light sources such as infrared light-emitting diodes and/or lasers and corresponding light detectors such as infrared photodetectors that can detect when external objects are within a predetermined distance), optical sensors such as visual odometry sensors that gather position and/or orientation information using images gathered with digital image sensors in cameras, gaze tracking sensors, visible light and/or infrared cameras having digital image sensors configured to gather image data, optical sensors for measuring ultraviolet light, and/or other optical sensor components (e.g., light sensitive devices and, if desired, light sources), photodetectors coupled to light guides, associated light emitters, and/or other optical components (one or more light-emitting devices, one or more light-detecting devices, etc.).

The optical sensors of sensors 36 may include color ambient light sensors that can measure ambient light levels. Each color sensor may have multiple photodetectors (e.g., photodiodes) covered with respective color filters corresponding to multiple respective color channels. The color filters may be configured to pass light of different colors (e.g., a red filter may pass red light for detection by a red photodiode in a red ambient light sensor channel, a blue filter may pass blue light for detection by a blue photodiode in a blue ambient light sensor channel, etc.). There may be, for example, 3-8 overlapping channels, at least 3 channels, at least 5 channels, fewer than 10 channels, or other suitable number of channels in each color ambient light sensor.

As shown in FIG. 2, the color ambient light sensors of device 10 may include front color ambient light sensor 42, which may sometimes be referred to as a front sensor or front light sensor, and rear color ambient light sensor 44, which may sometimes be referred to as a rear sensor or rear light sensor. The color ambient light sensors in device 10 may face in different directions and/or may have different angles of view, thereby helping device 10 to satisfactorily sense the intensity and color of light in the user's environment. For example, the sensors 42 and 44 may face in opposite directions and/or two or more or three or more color ambient light sensors in device 10 may otherwise face in different directions to allow light readings from different directions to be used in determining how to adjust the white point of display 14.

If desired, device 10 may include other components 40 such as audio components, power components, batteries, haptic devices, etc.

Figure 3:
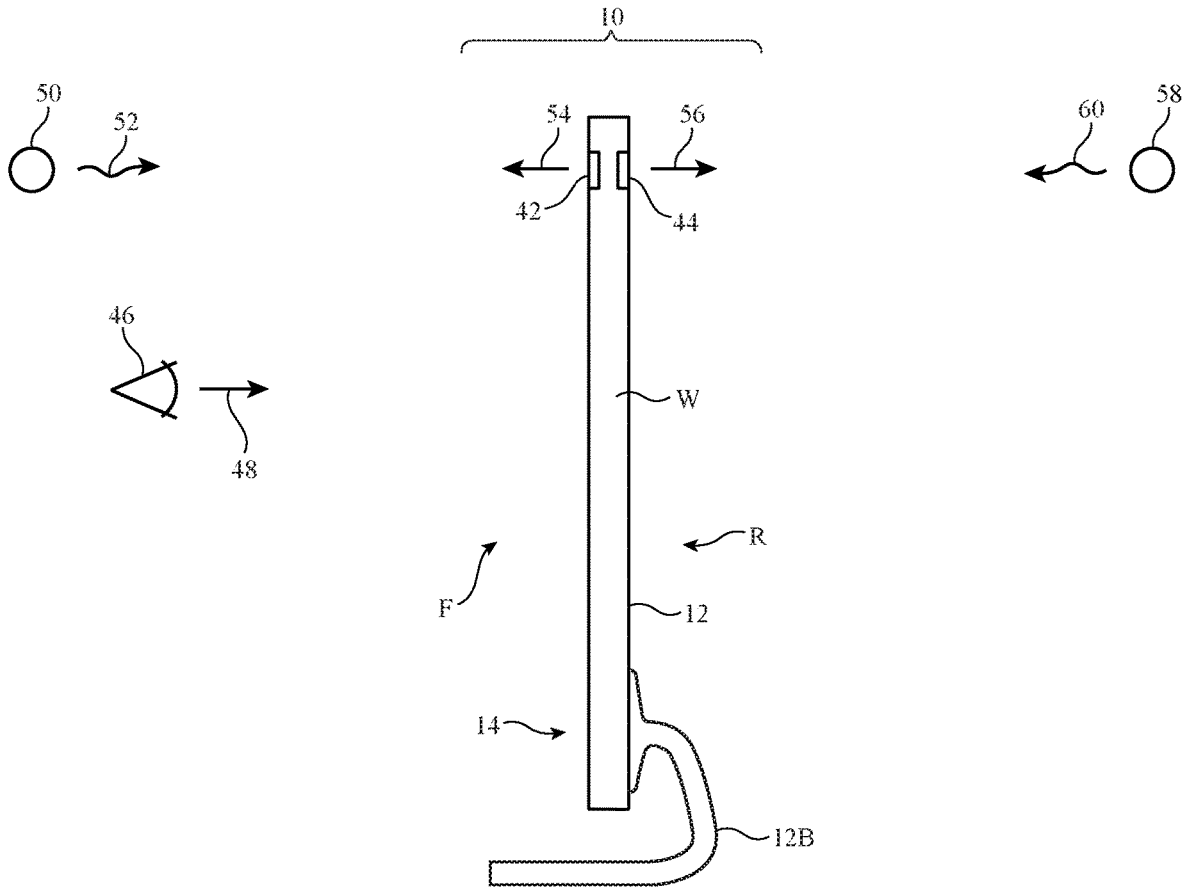
FIG. 3 is a cross-sectional side view of an illustrative electronic device in accordance with an embodiment.

A cross-sectional side view of device 10 of FIG. 2 is shown in FIG. 3. As shown in FIG. 3, portions of housing 12 may be formed on front face F and opposing rear face R. Sidewall portions of housing such as sidewalls W may extend between front face F and rear face R. Portion 12B of housing 12 may form an optional stand to support device 10 so that display 14 may be viewed in direction 48 by user (viewer) 46. Display 14 has pixels that display an image viewable on front face F (e.g., an image viewable through optional overlapping transparent portions of housing 12 that form a display cover layer on front face F). Front sensor 42 is mounted on front face F of housing 12 or elsewhere in device 10 that allows front sensor 42 to face outwardly from front face F (e.g., in direction 54, towards user 48). Front sensor 42 can therefore sense ambient light such as ambient light 52 from objects 50 that are located in front of device 10. Opposing rear sensor 44 is mounted on rear face R of housing 12 or elsewhere in device 10 that allows rear sensor 44 to face outwardly from rear face R (e.g., in direction 56, away from rear face R and away from user 46). This allows rear sensor 44 to measure ambient light 60 from objects such as object 58 to the rear of device 10. By using both rear and front ambient light measurements, control circuitry 30 can make satisfactory dynamic color adjustments (e.g., white point adjustments), intensity adjustments, and/or other adjustments to display 14 during operation of device 10. For example, dynamic white point adjustments may be made to ensure that images that are presented on display 14 for user 46 are pleasing to the eye and are not too warm or too cold for the user's lighting environment.

As a user views display 14 on front face F, the user may also view objects such as object 58 that are located to the rear of device 10 and display 14. For example, device 10 may be located on a desk in front of a window. The window (e.g., object 58 of FIG. 3) may allow bright cool daylight into the user's working environment. As the user views images on display 14, the user's eyes will adapt to the relatively cold daylight from the window. Unless the color cast of display 14 is adjusted, the difference between the color of the ambient window light and the color cast of the image on display 14 will be unsettling to the user (e.g., the image on display 14 will appear too warm). To ensure that an image on display 14 is pleasing to the user, control circuitry 30 can automatically adjust the white point of display 14 to a colder value. At night, when the window behind device 10 is dark, the user's work environment may be lit solely by a warm incandescent light source in front of display 14 (e.g., object 50 of FIG. 3). In these lighting conditions, the user's eyes will adapt to the warmer ambient light that is present and control circuitry 30 can automatically adjust the white point of display 14 to a warmer value to ensure that images on display 14 are pleasing to the user.

Often user 46 will use display 14 in an ambient lighting environment that has a mixture of light sources. For example, warm and/or cold light may be present to the rear of device 10 and warm and/or cold light may be present to the front of device 10. In these mixed lighting conditions, control circuitry 30 can perform weighting operations or other operations that allow color measurements from front sensor 42 and rear sensor 44 to be combined and used to select a compromise white point setting for display 14. The combining scheme that is used in weighting the front and rear sensor data may vary depending on the relative intensity of rear and front light measurements. As an example, measured color values from the front and rear sensor may be weighted using a first weighting schemes such as a linear-luminance weighting scheme when the rear sensor reading is greater than the front sensor reading (e.g., in rear lit scenarios), whereas measured color values from the front and rear sensor may be weighted using a second weighting scheme such as a log-luminance weighting scheme when the front sensor reading is greater than the rear sensor reading (e.g., in front lit scenarios). Once front and rear sensor data has been satisfactorily combined to produce a weighted average color measurement or other color value, this color information can be used by control circuitry 30 to adjust the white point (color cast) of display 14 or take other suitable action.

Figure 4:
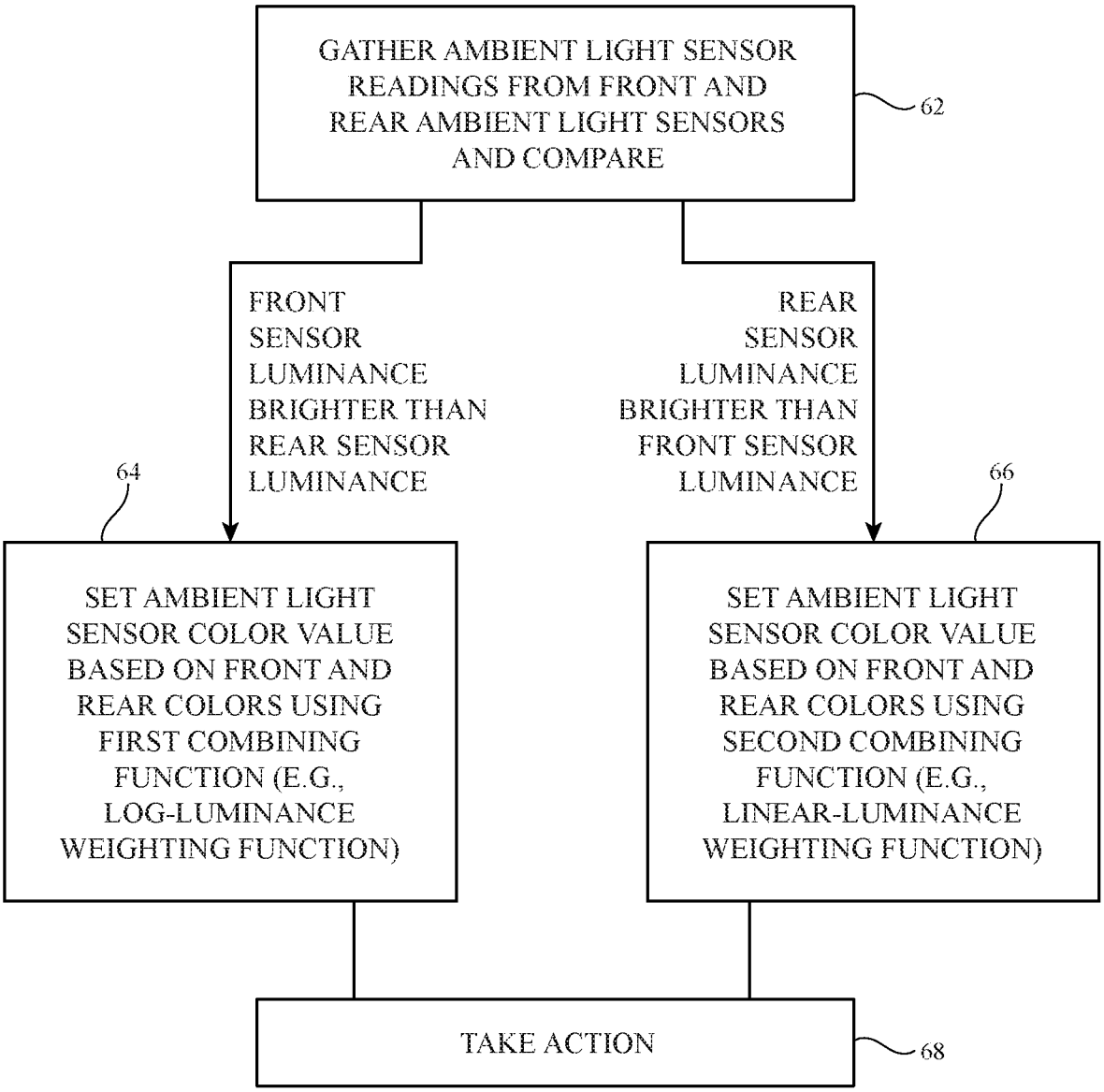
FIGS. 4 and 5 are flow charts of illustrative steps involved in using ambient light sensor information from front and rear ambient light sensors to make display adjustments in accordance with embodiments.

A flow chart of illustrative operations involved in using ambient light readings from front sensor 42 and rear sensor 44 is shown in FIG. 4. During the operations of block 62, control circuitry 30 may gather ambient light sensor readings from front color ambient light sensor 42 and from rear color ambient light sensor 44. Each reading may include an ambient light luminance (light intensity) value and an ambient light color (color coordinate) value. The front and rear intensities may be compared to determine whether the magnitude of the ambient light to the rear of device 10 is greater than or less than the magnitude of the ambient light to the front of device 10. If the light intensity reading of rear sensor 44 is greater than the light intensity reading of front sensor 42, for example, control circuitry 30 can conclude that device 10 is being operated in a rear lit scenario. If the light intensity of sensor 42 exceeds that of sensor 44, control circuitry 30 can conclude that device 10 is being operated in a front lit scenario.

During use of device 10 by a user, the user tends to persistently view display 14 in direction 48. As a result, the user's eyes can be more easily influenced by ambient light to the rear of device 10 than to the front of device 10. Nevertheless, in situations in which both rear and front light sources are present, both rear light and front light contribute to the user's ambient lighting environment and should be taken into account by control circuitry 30 in determining an appropriate white point for display 14.

Consider, as an example, a first illustrative scenario in which front light 52 is brighter than rear light 60. In this type of scenario, which may sometimes be referred to as a front-lit scenario, a front sensor color value measured using front sensor 42 and a rear sensor color value measured using rear sensor 44 may be combined using a first combining function (see, e.g., the operations of block 64). The first combining function may take as inputs the front and rear color measurements from sensors 42 and 44, respectively. These inputs may be combined in accordance with weights derived from the front and rear luminance measurements from sensors 42 and 44. With one illustrative configuration, which may sometimes be referred to as a log-luminance weighting configuration, the front and rear color values are weighted using logarithms of the respective front and rear luminance values. This is shown in equation 1, where LOG(LUXF) is the logarithm of the light intensity measured with front sensor 42, COLF is the color measured with front sensor 42, LOG(LUXR) is the logarithm of the light intensity measured with rear sensor 44, COLR is the color measured with rear sensor 44, and COLOR is the output of the first ambient light color measurement combining function.

$$COLOR=LOG(LUXF)*COLF+LOG(LUXR)*COLR \quad (1)$$

In a second illustrative scenario, rear light 60 is brighter than front light 52. In this type of scenario, which may sometimes be referred to as a rear-lit scenario, the front sensor color value measured using front sensor 42 and the rear sensor color value measured using rear sensor 44 may be combined using a second combining function (see, e.g., the operations of block 66). The second combining function may take as inputs the front and rear color measurements from sensors 42 and 44, respectively. These inputs may be combined in accordance with weights derived from the front and rear luminance measurements from sensors 42 and 44 (which serve as additional inputs to the combining function). With an illustrative arrangement, which may sometimes be referred to as a linear-luminance weighting configuration, the front and rear color values are weighted using weights produced from the respective front and rear luminance values. This is shown in equation 2, where LUXF is the light intensity measured with front sensor 42, COLF is the color measured with front sensor 42, LUXR is the light intensity measured with rear sensor 44, COLR is the color measured with rear sensor 44, and COLOR is the output of the second ambient light color measurement combining function.

$$COLOR=LUXF*COLF+LUXR*COLR \quad (2)$$

In front lit conditions, the combining function that is used (e.g., the log-luminance weighting function in this example) is less sensitive to the contribution of front ambient light and has an elevated sensitivity to the contribution of rear ambient light relative to the combining function that is used in rear lit conditions (e.g., the linear-luminance weighting function in this example). Because the combining function that is used (e.g., the linear weighting function or log weighting function or other suitable combining function such as other weighting functions that use weights based on measured ambient light intensities), changes as a function of lighting conditions, this type of combining operation may sometimes be referred to as a conditional combining operation or a conditional weighting function.

As this example demonstrates, the use of a conditional weighting function approach allows control circuitry 30 to deemphasize front ambient light color measurements relative to rear color ambient light color measurements in conditions in which ambient lighting is predominantly in the front of device 10 rather in the rear of device 10. This may help prevent control circuitry 30 from being overly sensitive to lighting conditions in the front of device 10. The user's eye tends to strongly adapt to the color of rear ambient light because objects to the rear of device 10 are in the user's view when the user is viewing display 14, so preventing control circuitry 30 from being overly sensitive to lighting conditions in the front of device 10 in front lit conditions may help adjust display 14 in a way that is pleasing to the user.

After producing a combined ambient light color measurement (color value COLOR), control circuitry 30 can adjust the white point (color cast) of display 14 accordingly or may make other suitable adjustments to device 10 during the operations of block 68. Examples of adjustments that may be made include white point adjustments for cameras in device 10, adjustments to camera flash color casts, adjustments to the brightness of display 14, and adjustments to other optical components in device 10. The use of the measured ambient light color value COLOR to dynamically adjust the color cast of display 14 (e.g., the white point of display 14) is illustrative.

In some systems, multiple displays may be present. For example, a first electronic device may have a first display and may have first front and rear ambient light sensors and a second electronic device may have a second display and may have second front and rear ambient light sensors. The light sensors may each make color and luminance measurements on ambient light. Control circuitry 30 can then use these measurements (with appropriate combining operations) to determine an appropriate white point for the first and second displays. The white point of the first and second displays may, as an example, be adjusted together and may have the same value.

Figure 5:
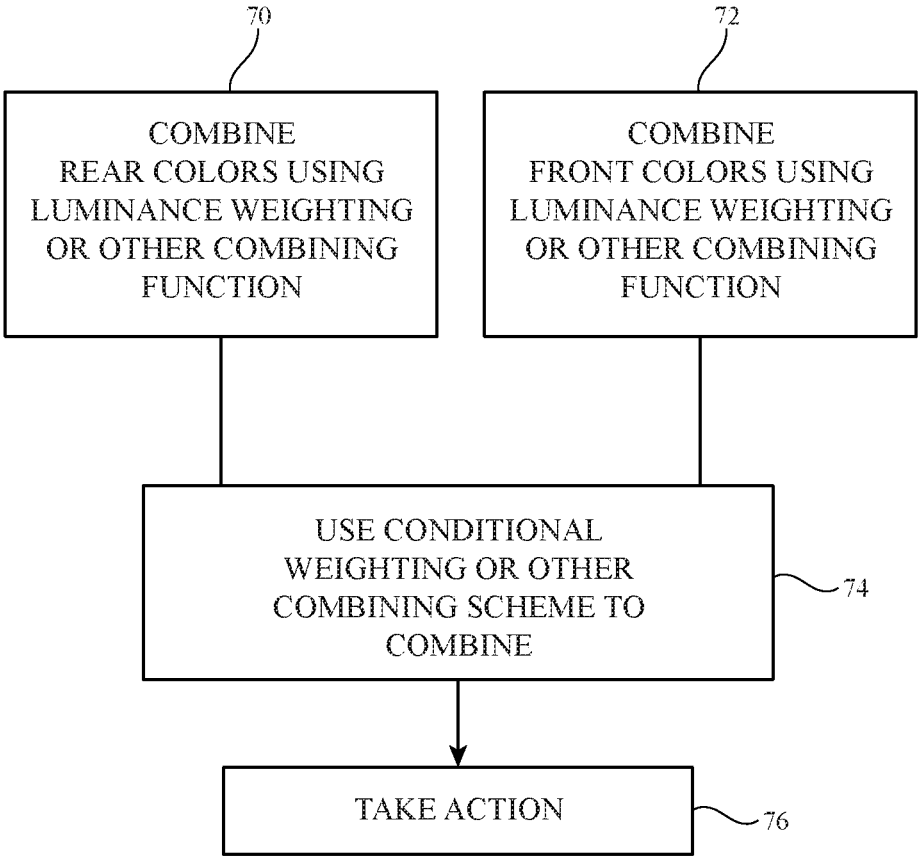

A flow chart of illustrative operations involved in adjusting the color cast of first and second displays in system 8 is shown in FIG. 5.

During the operations of block 70, control circuitry 30 may use the first and second rear ambient light sensors to gather respective first and second rear ambient light measurements. A linear-luminance weighting function (using the rear sensor luminance measurements as weights for the rear sensor color measurements) or other suitable combining function may then be used to combine these two readings into a combined rear color measurement REARCOLOR.

During the operations of block 72, control circuitry 30 may use the first and second front ambient light sensors to gather respective first and second front ambient light measurements. A linear-luminance weighting function (using the front sensor luminance measurements as weights for the front sensor color measurements) or other suitable combining function may then be used to combine these two readings into a combined front color measurement FRONTCOLOR.

During the operations of block 74, a conditional weighting scheme of the type described in connection with FIG. 4 or other suitable combining operation may be used to combine the color measurements REARCOLOR and FRONTCOLOR to produce a combined ambient light reading for device 10 (e.g., to produce combined ambient light color measurement COLOR using a first combining function in front lit scenarios and a second combining function in rear lit scenarios). The value of COLOR can be used during the operations of block 76. For example, control circuitry 30 can use the value of COLOR to adjust the white point of the first display and to adjust the white point of the second display. The white points of the first and second displays may be equal to avoid color mismatch between displays. In scenarios in which three or more displays are present, three or more rear color measurements may be combined during the operations of block 70 and three or more front color measurements may be combined during the operations of block 72. After combining the front and rear color measurements during block 74 to produce combined color value COLOR, control circuitry 30 can adjust the white points of the three or more displays using the combined value of COLOR during the operations of block 76.

As these examples illustrate, the combining function used to combine the ambient light sensor measurements may, if desired, use luminance-based weights such as linear and logarithmic weights. Other luminance-based combining schemes may be used if desired (e.g., linear combining functions, non-linear combining functions, functions with thresholds and/or steps, functions with color coordinate offsets, and/or other combining operations). The resulting combined color measurements (e.g., combined color value COLOR) may represent an average, a weighted average, or a color value that is a combination of multiple color measurement inputs (e.g., front and rear sensor readings) but that is not a direct linear combination of the color measurement inputs. Steps and offsets may be applied in determining the value of COLOR. If desired, the value of COLOR may be set to the color measured by the sensor with the greatest measured luminance (in a method sometimes referred to as a "winner take all" method). In general, any suitable way for determining a compromise or average color value based on both front and rear sensors may be used. Moreover, additional sensors and/or fewer sensors may be included in system 8. For example, a single rear sensor may be shared by multiple devices in a multiple-display system with multiple front sensors, a single front sensor may be shared by multiple devices in a multiple-display system with multiple rear sensors, sensors may be mounted on housing 12 so that ambient light readings are taken to the side (laterally) rather than directly to the rear or toward the front of device 10, sensor readings may be gathered using additional devices other than the devices whose displays are being adjusted based on the combined color value COLOR, and/or other configurations may be used for determining satisfactory color cast adjustments to make to the display(s) in device(s) 10 of system 8. If desired, display brightness may also be adjusted using measurements from the ambient light sensors. For example, in addition to or instead of adjusting the white point of one or more displays, the brightness of one or more displays can be adjusted based on measured ambient light intensity (e.g., to increase display brightness in bright lighting conditions and to decrease display brightness in dim lighting conditions). Ambient light intensities may be measured using front and rear sensors and can be combined using any suitable combining function (winner take all, linear-luminance or logarithmic-luminance weighted luminance values, other linear and/or non-linear combining functions, etc.). Ambient light sensor information (luminance and/or color) may, if desired, be used in taking actions such as adjusting shading, texture, or other on-screen effects for objects on display 14, can be used in otherwise controlling the rendering of electronic content on display 14 (e.g., adjusting the way in which electronic content such as text, graphics, animation, video, images, and other content is displayed), or can be used in controlling other device functions during the operation of device 10.

System 8 may gather and use personally identifiable information. It is well understood that the use of personally identifiable information should follow privacy policies and practices that are generally recognized as meeting or exceeding industry or governmental requirements for maintaining the privacy of users. In particular, personally identifiable information data should be managed and handled so as to minimize risks of unintentional or unauthorized access or use, and the nature of authorized use should be clearly indicated to users.

The foregoing is merely illustrative and various modifications can be made by those skilled in the art without departing from the scope and spirit of the described embodiments. The foregoing embodiments may be implemented individually or in any combination.

What is claimed is:

1. An electronic device, comprising:

a housing having opposing front and rear faces;

a display on the front face;

a front color ambient light sensor on the front face that is configured to gather a front ambient light color measurement and a front ambient light intensity measurement;

a rear color ambient light sensor on the rear face that is configured to gather a rear ambient light color measurement and a rear ambient light intensity measurement; and control circuitry configured to adjust the display based on:

a comparison of the front and rear ambient light intensity measurements, wherein the control circuitry is configured to combine the front and rear ambient light intensity measurements using a first combining function if the front ambient light intensity measurement is greater than the rear ambient light intensity measurement and wherein the control circuitry is configured to combine the front and rear ambient light intensity measurements using a second combining function if the rear ambient light intensity measurement is greater than the front ambient light intensity measurement; and the front and rear ambient light color measurements.

2. The electronic device defined in claim 1 wherein the control circuitry is configured to, during the comparison, determine whether the display is operating in a front lit environment in which the front ambient light intensity measurement is greater than the rear ambient light intensity measurement or whether the display is operating in a rear lit environment in which the front ambient light intensity measurement is less than the rear ambient light intensity measurement.

3. The electronic device defined in claim 2 wherein the first combining function comprises a first weighting function that the control circuitry uses to combine the first and second ambient light color measurements to produce a first combined ambient light color value in response to determining that the display is operating in the front lit environment and wherein the second combining function comprises a second weighting function that the control circuitry uses to combine the first and second ambient light color measurements to produce a second combined ambient light color value in response to determining that the display is operating in the rear lit environment.

4. The electronic device defined in claim 3 wherein the control circuitry is configured to adjust a white point of the display based on:

the first combined ambient light color value in response to determining that the display is operating in the front lit environment;

the second combined ambient light color value in response to determining that the display is operating in the rear lit environment.

5. The electronic device defined in claim 4 wherein the control circuitry is configured to use the first weighting function to produce the first combined ambient light color value by summing 1) a product of the front ambient light color measurement and a logarithm of the front ambient light intensity measurement and 2) a product of the rear ambient light color measurement and a logarithm of the rear ambient light intensity measurement.

6. The electronic device defined in claim 5 wherein the control circuitry is configured to use the second weighting function to produce the second combined ambient light color value by summing 1) a product of the front ambient light color measurement and the front ambient light intensity measurement and 2) a product of the rear ambient light color measurement and the rear ambient light intensity measurement.

7. The electronic device defined in claim 1 wherein the housing has a first portion and a second portion, wherein the display is mounted in the first portion and wherein the second portion forms a stand that supports the first portion.

8. The electronic device defined in claim 7 wherein the control circuitry is configured to combine the first and second ambient light color measurements to produce a combined color value using a combining function that uses the first and second ambient light intensity measurements.

9. The electronic device defined in claim 8 wherein the control circuitry is configured to adjust the display by adjusting a white point of the display based on the combined color value.

10. The electronic device defined in claim 9 wherein the combined color value is a weighted average of the first and second ambient light color measurements.

11. The electronic device defined in claim 10 wherein the control circuitry is configured to use the combining function to produce the weighted average using weights based on the first and second ambient light intensity measurements.

12. The electronic device defined in claim 1 wherein the control circuitry is configured to:

produce a combined color value from the first and second ambient light color measurements using a conditional weighting function; and adjust a white point of the display based on the combined color value.

13. The electronic device defined in claim 1 wherein the first combining function is a first log-intensity weighting function.

14. The electronic device defined in claim 13 wherein the second combining function is a second log-intensity weighting function.

15. The electronic device defined in claim 14 wherein the first and second log-intensity weighting functions are applied to the front and rear ambient light intensity measurements.

16. An electronic device, comprising:

a housing having a first portion with opposing front and rear faces and a second portion that forms a stand supporting the first portion;

a display mounted on the front face;

a front color ambient light sensor on the front face that is configured to gather a front ambient light color measurement and a front ambient light intensity measurement;

a rear color ambient light sensor on the rear face that is configured to gather a rear ambient light color measurement and a rear ambient light intensity measurement; and control circuitry configured to adjust the display using a combined ambient light color value produced using a conditional weighting function that weights the front and rear ambient light color measurements using the front and rear ambient light intensity measurements.

17. The electronic device defined in claim 16 wherein the conditional weighting function is configured to:

compare the front and rear ambient light intensity measurements;

in response to determining that the front ambient light intensity measurement is greater than the rear ambient light intensity measurement, use a first weighting function to produce the combined ambient light color value from the front and rear ambient light color measurements; and in response to determining that the rear ambient light intensity measurement is greater than the front ambient light intensity measurement, use a second weighting function that is different than the first weighting function to produce the combined ambient light color value from the front and rear ambient light color measurements.

18. A desktop computer, comprising:

a desktop computer housing having opposing front and rear faces;

a display on the front face;

a front color ambient light sensor on the front face that is configured to gather a front ambient light color measurement and a front ambient light intensity measurement;

a rear color ambient light sensor on the rear face that is configured to gather a rear ambient light color measurement and a rear ambient light intensity measurement; and control circuitry configured to adjust a white point of the display by comparing the front and rear ambient light intensity measurements, using a first combining function to produce a combined ambient light color value in response to determining that the front ambient light intensity measurement is greater than the rear ambient light intensity measurement, using a second combining function that is different than the first combining function to produce the combined ambient light color value in response to determining that the rear ambient light intensity measurement is greater than the front ambient light intensity measurement, and adjusting the white point based on the combined ambient light color value.

19. The desktop computer defined in claim 18 wherein the first combining function comprises a log-intensity weighting function in which the front and rear ambient light color measurements are weighted respectively by a logarithm of the front ambient light intensity and a logarithm of the rear ambient light intensity and wherein the second combining function comprises a linear-intensity weighting function in which the front and rear ambient light color measurements are weighted respectively by the front and rear ambient light intensity measurements.

* * * * *